US008465136B2

(12) United States Patent
Yuen

(10) Patent No.: US 8,465,136 B2
(45) Date of Patent: Jun. 18, 2013

(54) INK CARTRIDGE REFILL APPARATUS

(75) Inventor: Kenneth Yuen, Guang Dong (CN)

(73) Assignee: Dongguan Master Ink Co., Ltd., Dong Guan, Guang Dong (CN)

( * ) Notice: Subject to any disclaimer, the term of this patent is extended or adjusted under 35 U.S.C. 154(b) by 79 days.

(21) Appl. No.: 13/194,963

(22) Filed: Jul. 31, 2011

(65) Prior Publication Data

US 2013/0025743 A1 Jan. 31, 2013

(51) Int. Cl.
*B41J 2/175* (2006.01)

(52) U.S. Cl.
USPC ..... 347/86

(58) Field of Classification Search
USPC ..... 347/86
See application file for complete search history.

(56) References Cited

U.S. PATENT DOCUMENTS 6,361,158 B1 * 3/2002 Inoue et al. ..... 347/86
6,733,115 B2 * 5/2004 Santhanam et al. ..... 347/85
2006/0244794 A1 * 11/2006 Yuen ..... 347/86

* cited by examiner

*Primary Examiner* — Matthew Luu
*Assistant Examiner* — Alexander D Shenderov

(57) ABSTRACT

An ink cartridge refill apparatus includes an ink cartridge holder and an ink refill unit which are matched with each other. The ink cartridge holder has an accommodation chamber therein to accommodate an ink cartridge. The ink refill unit includes an ink tank and an ink delivery unit. An air extraction mechanism is provided on the ink cartridge holder to extract air from the ink cartridge. The ink cartridge holder has a passage for the air extraction mechanism to extract air relative to a nozzle of the ink cartridge. Through the air extraction mechanism, the ink cartridge is primed after being filled with ink, so that ink can freely flow to the nozzle of the ink cartridge from the ink tank of the ink cartridge. Compared to the prior art ink cartridge refill apparatus which needs an auxiliary tool to extract air after being refilled, the present invention is convenient for operation and can prevent the ink cartridge from leaking.

8 Claims, 10 Drawing Sheets

INK CARTRIDGE REFILL APPARATUS

BACKGROUND OF THE INVENTION

1. Field of the Invention

The present invention relates to an ink cartridge refill apparatus.

2. Description of the Prior Art

A conventional ink cartridge for an inkjet printer comprises a nozzle and an ink container which are an integral to one another. The ink cartridge comprises a sponge within the container such that the cartridge can be refilled with ink so that the ink cartridge can be reused.

This dedicated ink cartridge refill apparatus is designed for refilling this sponge type of ink cartridge. This ink cartridge refill apparatus comprises an ink cartridge holder and an ink refill unit. The ink cartridge holder is used to hold the ink cartridge. The ink refill unit comprises an ink tank and an ink delivery unit. When in use, the ink cartridge is secured in the ink cartridge holder, and then the ink refill unit is coupled to the ink cartridge holder. The ink delivery unit uses a needle to connect the ink cartridge with the ink tank, so that the ink is delivered to the ink cartridge from the ink tank. In this way, the ink cartridge can be refilled with ink.

Although the aforementioned ink cartridge refill apparatus refills the ink cartridge, there are some shortcomings existing in the ink cartridge refill apparatus. The ink cartridge has a hollow chamber immediately above the nozzle and underneath the filter of the ink cartridge. After the ink cartridge is refilled with ink, the hollow chamber usually remains filled with air. Before the ink cartridge is placed in the printer, the ink cartridge must be primed for the nozzle to effectively draw ink from the ink cartridge. The conventional means of priming uses a needle to extract air from the hollow chamber above the nozzle of the ink cartridge. However, it is inconvenient for the user to operate. Sometimes, the operation is not controlled well, and as a result ink may leak and spoil the user's clothes, hands and environment.

The conventional ink cartridge refill apparatus uses a hook on the ink cartridge holder to hook the side edge of the ink cartridge thereby securing the ink cartridges in the refill apparatus. The hook does not secure the ink cartridge effectively. When filling with ink, the ink may leak from the nozzle at the bottom of the ink cartridge.

Accordingly, the inventor of the present invention has devoted himself based on his many years of practical experiences to solve these problems.

The ink refill unit has an ink cartridge holder with a plate on the top that holds the cartridge down securely. Further more, the nozzles are sealed in a chamber which communicates directly with the priming device and thus already in a position to be primed.

SUMMARY OF THE INVENTION

The primary object of the present invention is to provide an ink cartridge refill apparatus to overcome the shortcomings of the prior art and to solve the problem that the ink cartridge cannot be removed from the ink refill apparatus and used immediately after being filled with ink.

Another object of the present invention is to provide an ink cartridge refill apparatus, which can secure the ink cartridge effectively and can prevent the ink cartridge from leakage.

A further object of the present invention is to provide an ink cartridge refill apparatus, which can provide a robust connection between the ink refill unit and the ink cartridge holder.

In order to achieve the abovementioned objectives, the invention discloses an ink cartridge refill apparatus comprising an ink cartridge holder and an ink refill unit which are connected together when in use. The ink cartridge holder has an accommodation chamber therein to accept an ink cartridge. The ink refill unit includes an ink tank and an ink delivery unit. The ink delivery unit is used to deliver ink from the ink tank to the ink cartridge in the ink cartridge holder. An air extraction mechanism is provided in the ink cartridge holder to extract air from the ink cartridge. The ink refill unit has a plate on the top that holds the cartridge down securely. Further more, the nozzles are sealed in a chamber which communicates directly with the priming device and thus already in a position to be primed. The ink cartridge holder has a passage for the air extraction mechanism to extract air relative from chamber above the nozzle of the ink cartridge. Through the air extraction mechanism, the ink cartridge is primed after being filled with ink, so that air is removed from the nozzle of the ink cartridge and the chamber behind the nozzle of the ink cartridge. Compared to the prior art cartridge refill apparatus which needs an auxiliary tool to extract air after being taken out, the present invention is convenient and can prevent the leakage of ink.

By encompassing the air extraction mechanism in the ink cartridge holder, no extra step is necessary after refilling. When the ink refill unit is coupled to the ink cartridge holder, the air extraction mechanism is in a state waiting to prime. When the ink refill unit is detached from the ink cartridge holder, the air extraction mechanism primes the cartridge to extract air. This allows for the ink cartridge to be removed from the refill unit having already been primed so as to simplify the process of refilling ink.

The locking member covers the top surface of the ink cartridge to replace the conventional hook to hook the side edge of the ink cartridge, such that the ink cartridge can be pressed tightly to prevent the leakage from the ink cartridge.

A click-and-lock mechanism is employed between the ink cartridge holder and the ink refill unit. The connection between the ink refill unit and the ink cartridge of the present invention is secure and stable to ensure a smooth ink refill procedure.

The air extraction mechanism exhausts air out of the cartridge and prevents air from reentering the ink cartridge through the combination of an air extraction passage and an air exhaust passage in conjunction with a first one-way valve and a second one-way valve. The ink cartridge can be primed smoothly and effectively to remove air from the chamber and passages between the nozzle and the ink tank.

DETAILED DESCRIPTION OF THE PREFERRED EMBODIMENTS

Embodiments of the present invention will now be described, by way of example only, with reference to the accompanying drawings.

As shown in FIG. 1 through FIG. 10, the ink cartridge refill apparatus of the preferred embodiment of the present invention comprises an ink cartridge holder 10 and an ink refill unit 20 which are matched with each other.

Figure 1:
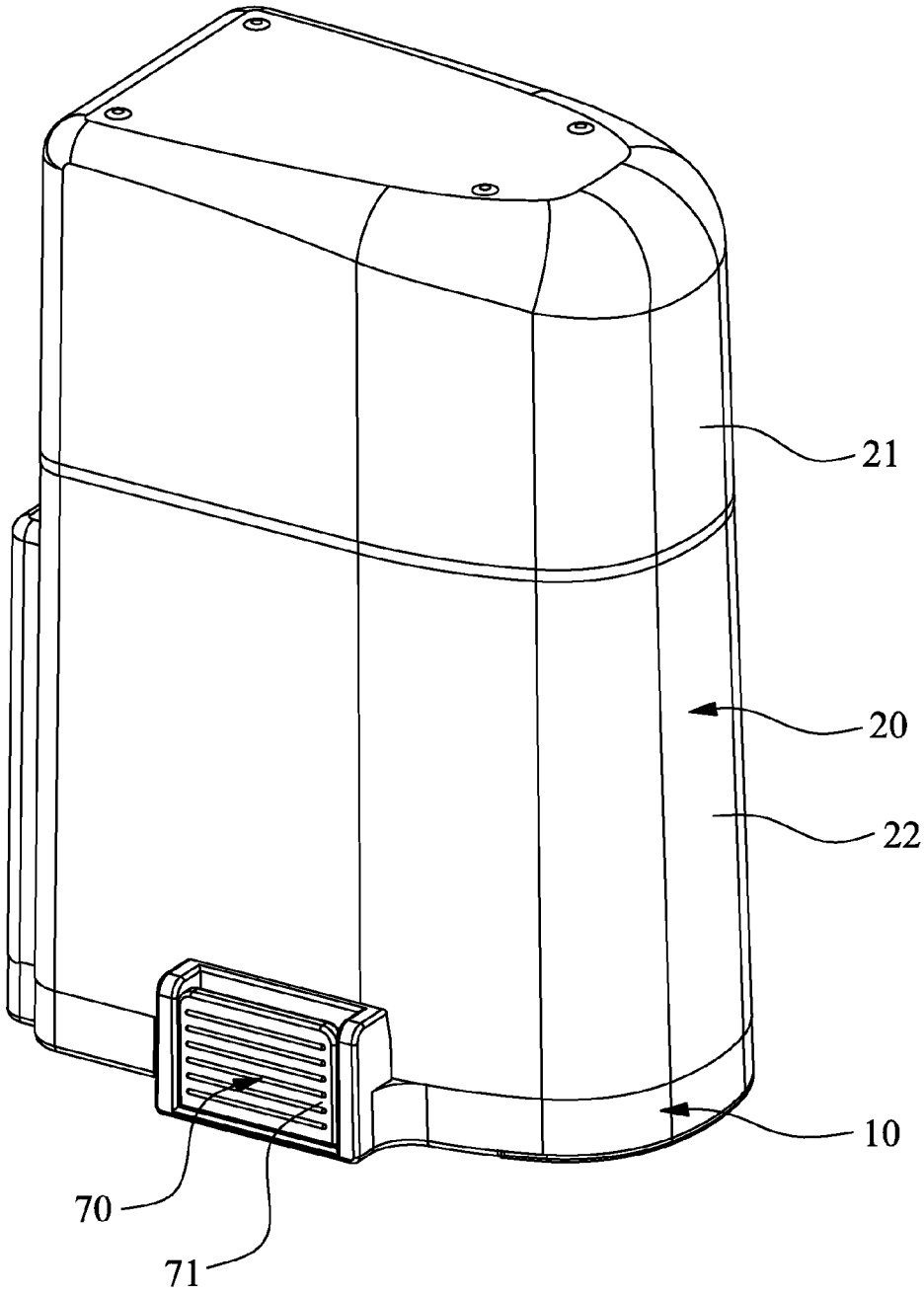
FIG. 1 is a perspective view of the preferred embodiment of the present invention.
Figure 2:
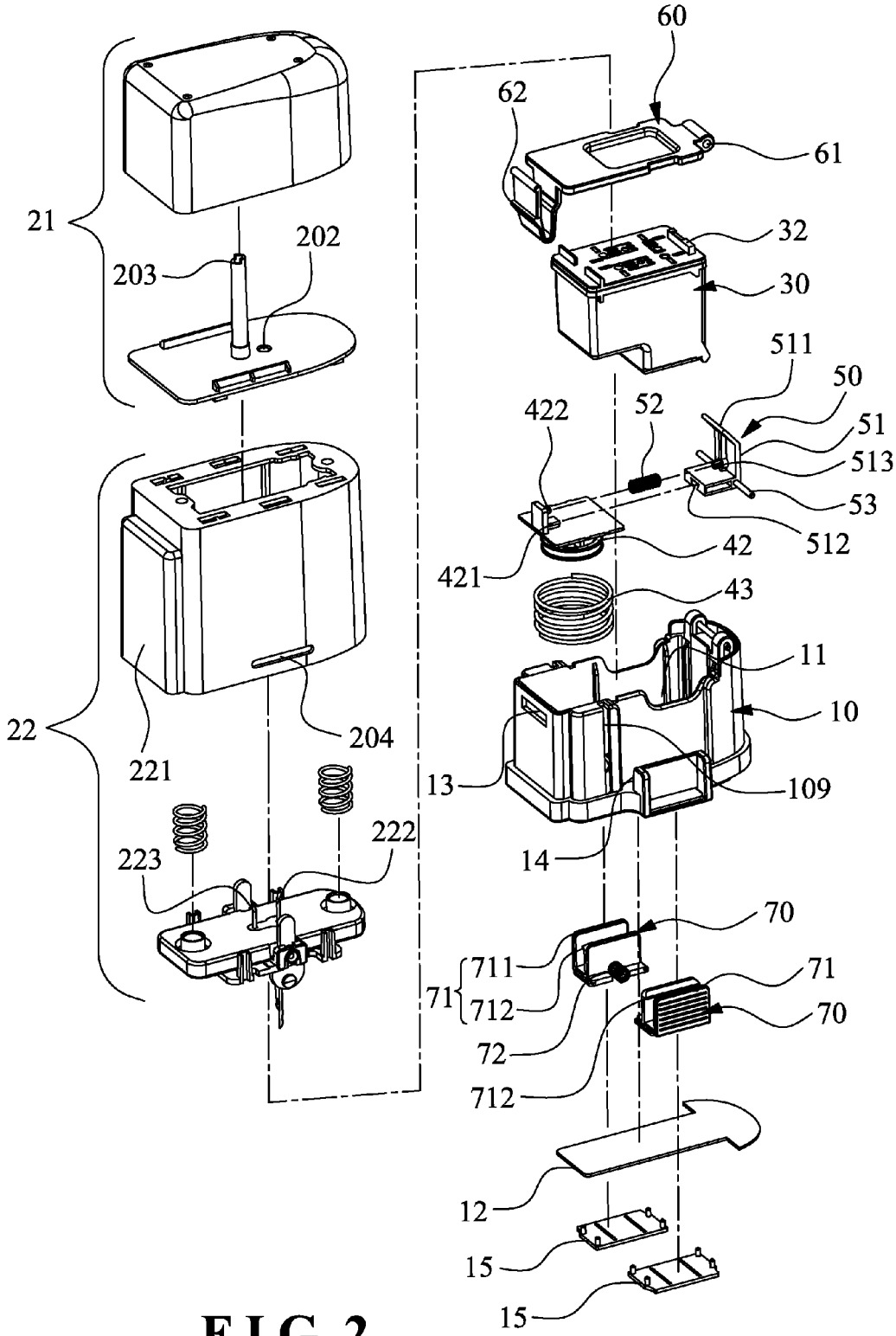
FIG. 2 is an exploded view of the preferred embodiment of the present invention.
Figure 6:
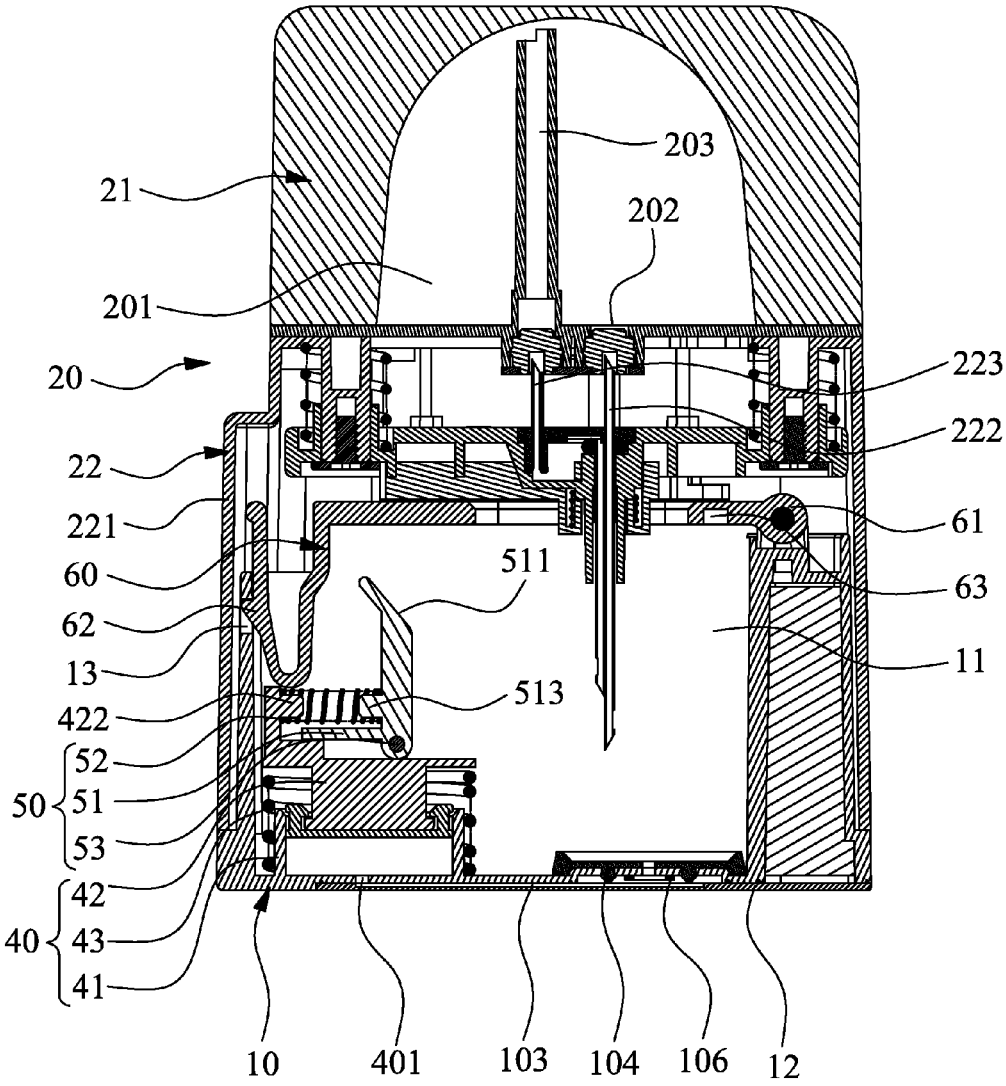
FIG. 6 is a cross sectional view of the preferred embodiment of the present invention.

As shown in FIG. 2 and FIG. 6, the ink cartridge holder 10 accommodates an ink cartridge 30. The ink cartridge holder 10 has an accommodation chamber 11 therein. The accommodation chamber 11 is used to hold the ink cartridge 30. An air extraction mechanism 40 is provided on the ink cartridge holder 10. The air extraction mechanism 40 is used to extract air from the ink cartridge 30. In this embodiment, the air extraction mechanism 40 is located in the accommodation chamber 11. The air extraction mechanism 40 comprises an air cylinder 41, a piston 42 and a return spring 43. The air cylinder 41 extends upward from an inner bottom surface of the accommodation chamber 11. The air cylinder 41 has a bottom formed with an air extraction hole 401 and an air exhaust hole 402. Both the air extraction hole 401 and the air exhaust hole 402 communicate with the inside of the air cylinder 41. The piston 42 is movably disposed of in the air cylinder 41. The distal end of the piston 42 extends out of the air cylinder 41. The ends of the return spring 43 rest against the inner bottom surfaces of the piston 42 and the accommodation chamber 11 respectively. The return spring 43 acts on the piston 42 to provide an upward return force to the piston 42.

Figure 7:
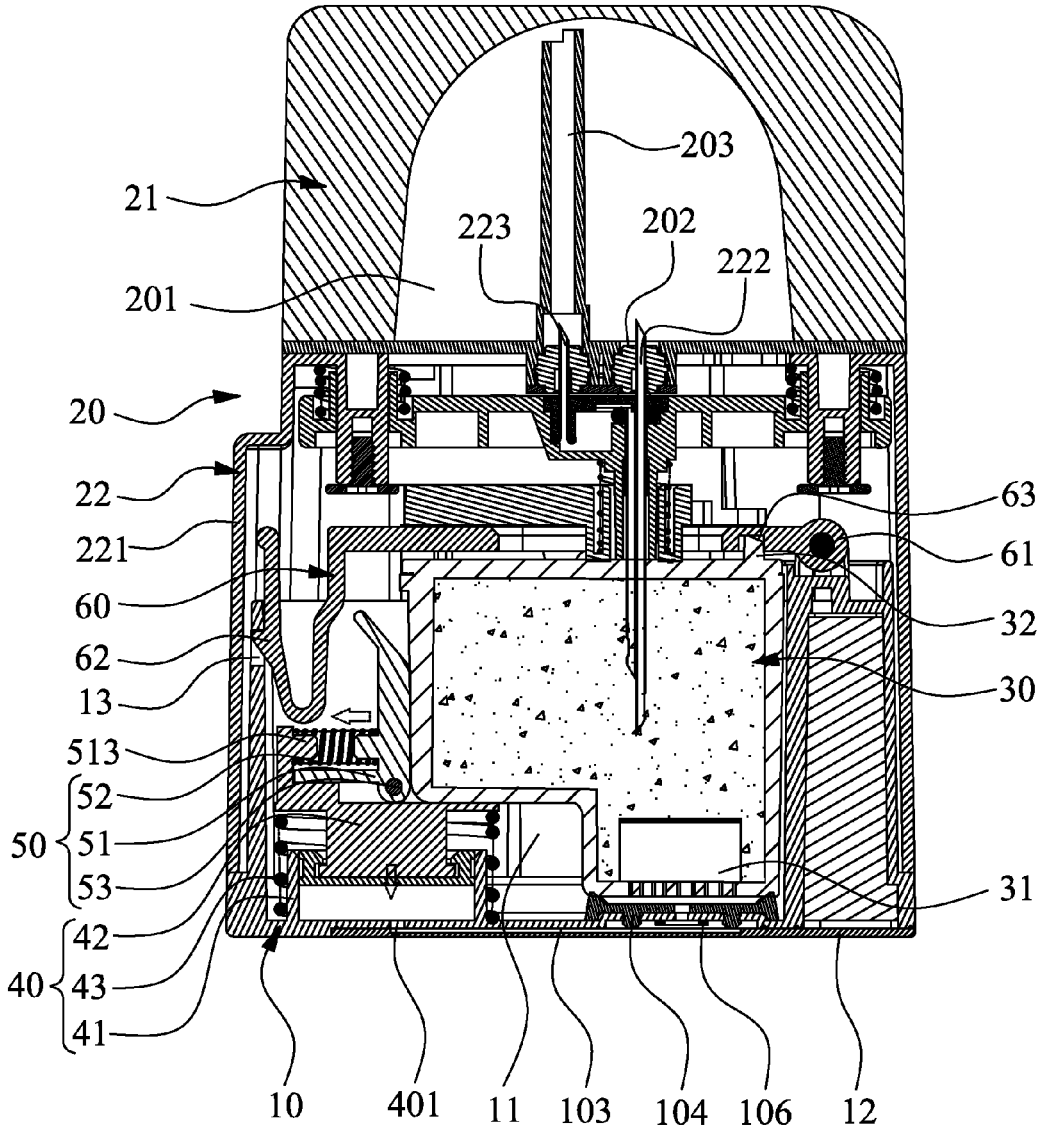
FIG. 7 is a cross sectional view of the preferred embodiment of the present invention provided with the ink cartridge.
Figure 9:
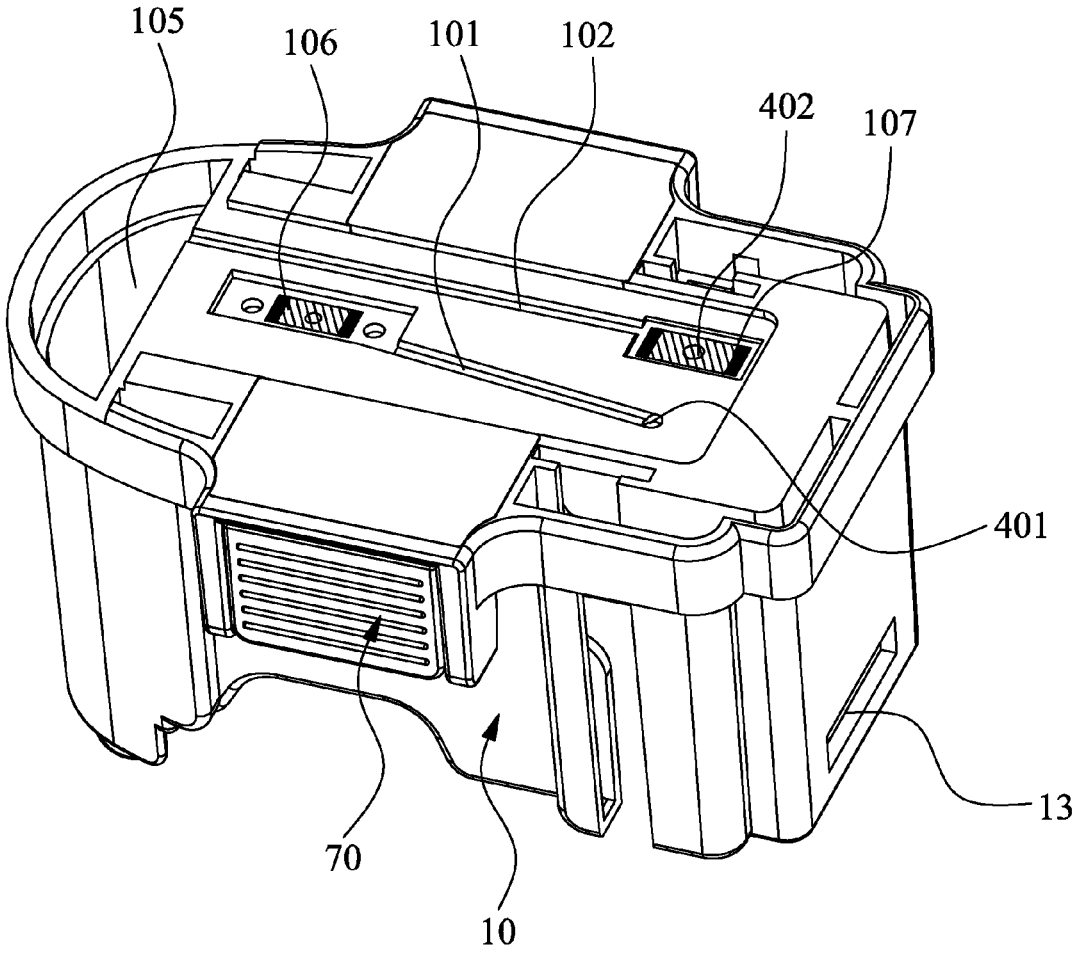
FIG. 9 is a bottom view of the ink cartridge holder of the preferred embodiment of the present invention.

FIG. 7 shows the ink cartridge holder 10 comprises a bottom plate 12 which is detachedly connected to the bottom of the ink cartridge holder 10. FIG. 9 shows the bottom of the ink cartridge holder 10 which has a first groove 101 and a second groove 102. The bottom plate 12 and the first groove 101 as well as the second groove 102 respectively define an air extraction passage 103 and an air exhaust passage (not shown in the drawings). The air extraction passage 103 is used to extract air for the ink cartridge 30. The air extraction passage 103 has an air inlet end provided with a rubber seal 104. The ink cartridge 30 has a nozzle 31 which presses against the seal 104 to connect with the air extraction passage 103. The air extraction passage 103 has an air outlet end which interconnects with the air extraction hole 401 of the air extraction mechanism 40. The bottom of the ink cartridge holder 10 has a recess 105. The air exhaust passage connects with the recess 105 and the air exhaust hole 402 of the air extraction mechanism 40. The air exhaust passage is used to exhaust the air in the air extraction mechanism 40. The recess 105 may be provided with a fitting (such as a sponge) to draw ink, preventing the ink cartridge 30 from leaking. The air extraction passage 103 is provided with a first one-way valve 106. When the air extraction mechanism 40 is in an air extraction state, the first one-way valve 106 will be opened to allow nozzle 31 to communicate with the air extraction hole 401. The air exhaust passage is provided with a second one-way valve 107. When the air extraction mechanism 40 is in an air pumping state, the second one-way valve 107 will be opened for the air exhaust hole 402 to communicate with the recess 105. The first one-way valve 106 is disposed at the air inlet end of the air extraction passage 103. The second one-way valve 107 is disposed at the air exhaust hole 402 of the air exhaust passage, as shown in FIG. 9. The position of the first one-way valve 106 and the second one-way valve 107 is not limited to the preferred embodiment.

Figure 4:
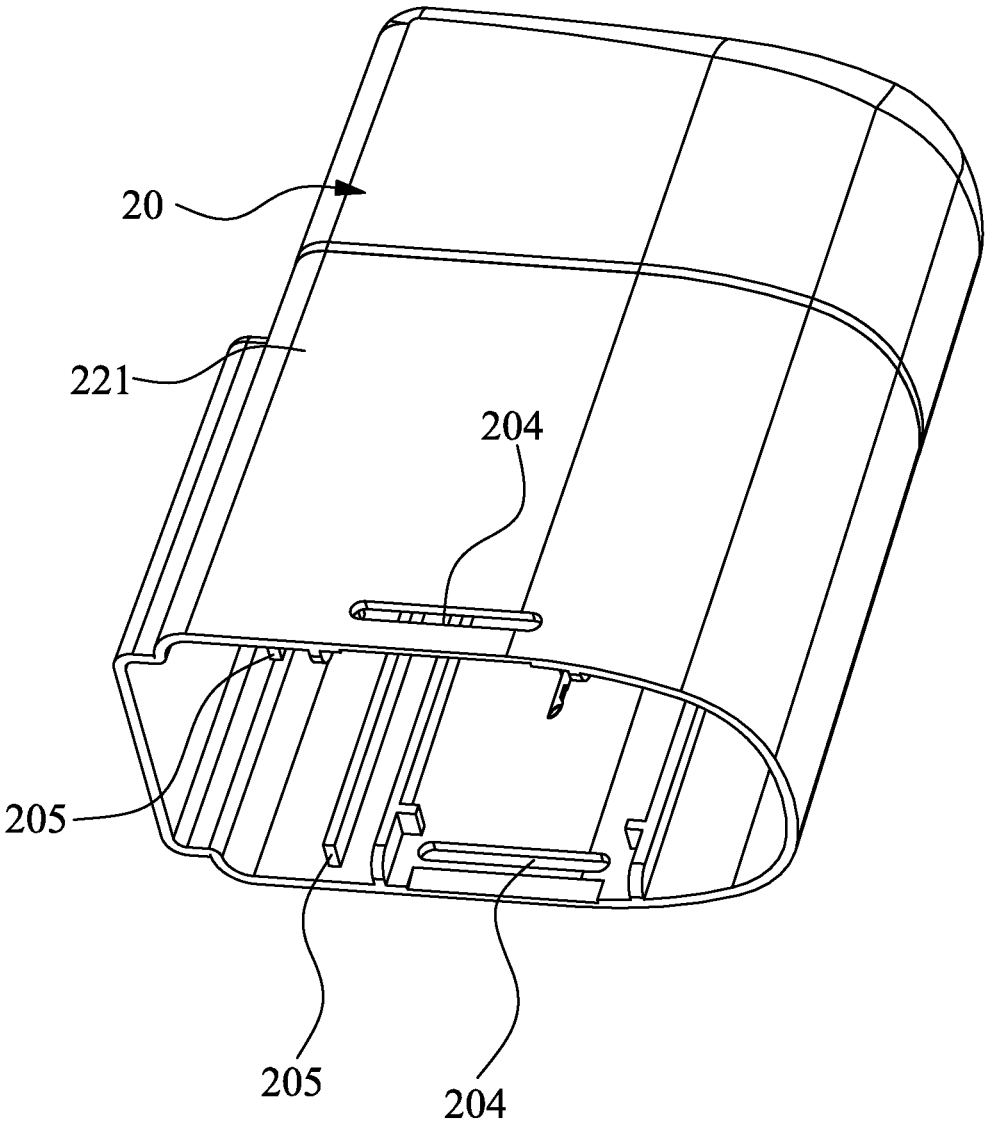
FIG. 4 is an enlarged view showing the preferred embodiment of the ink refill unit of the present invention.
Figure 5:
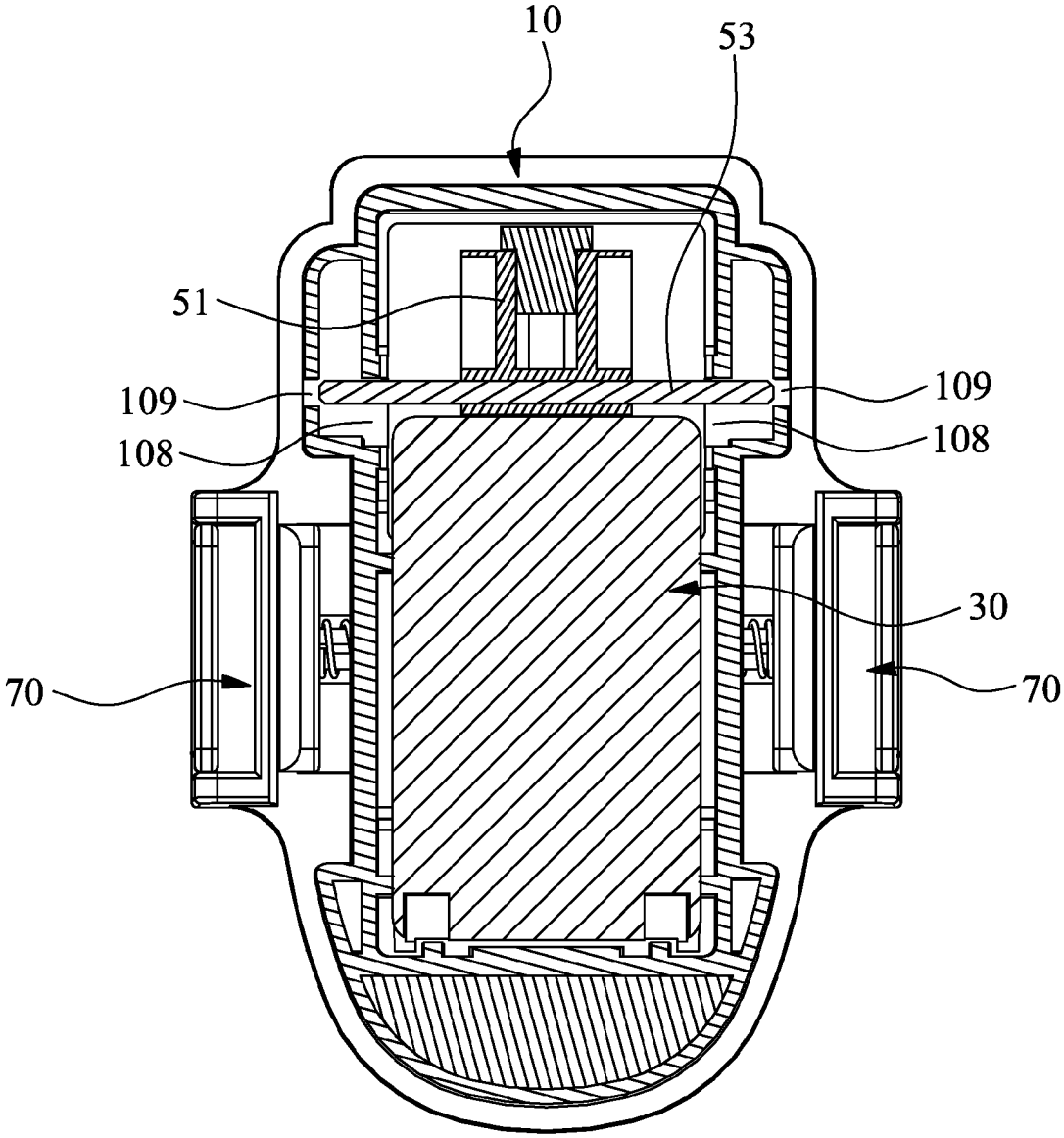
FIG. 5 is a cross sectional view of the ink cartridge holder of the preferred embodiment of the present invention.

As shown in FIG. 2 and FIG. 6, a cartridge detection mechanism 50 is provided in the accommodation chamber 11 of the ink cartridge holder 10. This mechanism 50 is used to detect the existence of the ink cartridge 30. The mechanism 50 is located on the piston 42 of the air extraction mechanism 40 and moves up and down along with movement of the piston 42. The mechanism 50 comprises a fastening block 51 and an elastic member 52. The fastening block 51 is transversely moveable relative to the piston 42. The elastic member 52 acts on the fastening block 51, so that the fastening block 51 extends transversely to fasten the ink cartridge 30. The fastening block 51 further has a limit post 53. The limit post 53 is longitudinally disposed in the accommodation chamber 11. The inner wall of the accommodation chamber 11 has a pair of limit troughs 108 corresponding to two ends of the limit post 53. The limit troughs 108 extend vertically. The two ends of the limit post 53 can be moved vertically and transversely and confined in the limit troughs 108. Two sides of the ink cartridge holder 10 have a pair of upright engaging grooves 109. As shown in FIG. 5, the engaging grooves 109 respectively communicate with the limit troughs 108 (FIG. 5). In an initial state, the two ends of the limit post 53 are not in the pair of engaging grooves 109. When the ink cartridge 30 is placed in the accommodation chamber 11, the ink cartridge 30 will push the limit post 53 to move transversely, so that the two ends of the limit post 53 are moved to the pair of engaging grooves 109. The ink refill unit 20 has engaging ribs 205 corresponding to the engaging grooves 109, as shown in FIG. 4. When the ink refill unit 20 is coupled to the ink cartridge holder 10, the engaging ribs 205 engage with the engaging grooves 109 and urge the limit post 53 to move downward. The downward movement of the limit post 53 brings the piston 42 to move downward so as to engage the air extraction mechanism 40. The way to engage the air extraction mechanism 40 is not limited to the preferred embodiment of the engaging ribs 205 pressing the limit post 53 to move the piston 42 downward. The air extraction mechanism 40 may be engaged by a switch, button or other method. One end of the fastening block 51 is fixedly connected to the limit post 53, and another end of the fastening block 51 has an inclined guide surface 511. The guide surface 511 guides the ink cartridge 30 to be placed in the accommodation chamber 11. The fastening block 51 further has a guide groove 512 which is a dovetail groove. An upper end of the piston 42 has a guide block 421. The guide block 421 is engaged in the guide groove 512, such that the fastening block 51 is moved in the direction of the guide block 421 relative to the piston 42. Further, the side of the fastening block 51 has a first protrusion 513, and the piston 42 has a corresponding second protrusion 422. The elastic member 52 is a spring. Two ends of the spring are fitted on the first protrusion 513 and the second protrusion 422.

As shown in FIG. 2 and FIG. 7, the ink cartridge holder 10 further comprises a locking member 60. The locking member 60 is used to secure the ink cartridge 30. The locking member 60 applies pressure to the ink cartridge 30 to tightly secure the ink cartridge 30. In this embodiment, one end of the locking member 60 has a pivot portion 61, and another end of the locking member 60 has a locking portion 62. The pivot portion 61 and the locking portion 62 are located outside two opposing sides of the ink cartridge 30, so that the press portion of the locking member 60 is located above the nozzle 31 of the ink cartridge 30. The pivot portion 61 is pivotally connected to the ink cartridge holder 10. The ink cartridge holder 10 has a locking slot 13 corresponding to the locking portion 62. The locking portion 62 is buckled to the locking slot 13. The inner side of the locking member 60 has a positioning recess 63. The ink cartridge 30 has a protrusion 32 thereon. The protrusion 32 is engaged in the positioning recess 63 to provide a positioning effect.

The ink refill unit 20 comprises an ink tank 21 and an ink delivery unit 22. As shown in FIG. 6, the ink tank 21 is used to store ink. The ink tank 21 has at least one ink chamber 201 therein. Each ink chamber 201 is provided with a bottom board which has an ink outlet 202 and a ventilated post 203. As shown in FIG. 2, the ink delivery unit 22 is used to deliver the ink from the ink tank 21 to the ink cartridge 30 in the holder 11. The ink delivery unit 22 comprises an outer casing 221, an ink needle 222 and a ventilated needle 223. The ink needle 222 and the ventilated needle 223 are located in the outer casing 221. The other parts in the ink delivery unit 22 are prior art and won't be described hereinafter. The ink tank 21 is disposed on top of the outer casing 221. The ink needle 222 is located corresponding to the ink outlet 202, and the ventilated needle 223 is located corresponding to the ventilated post 203.

Figure 8:
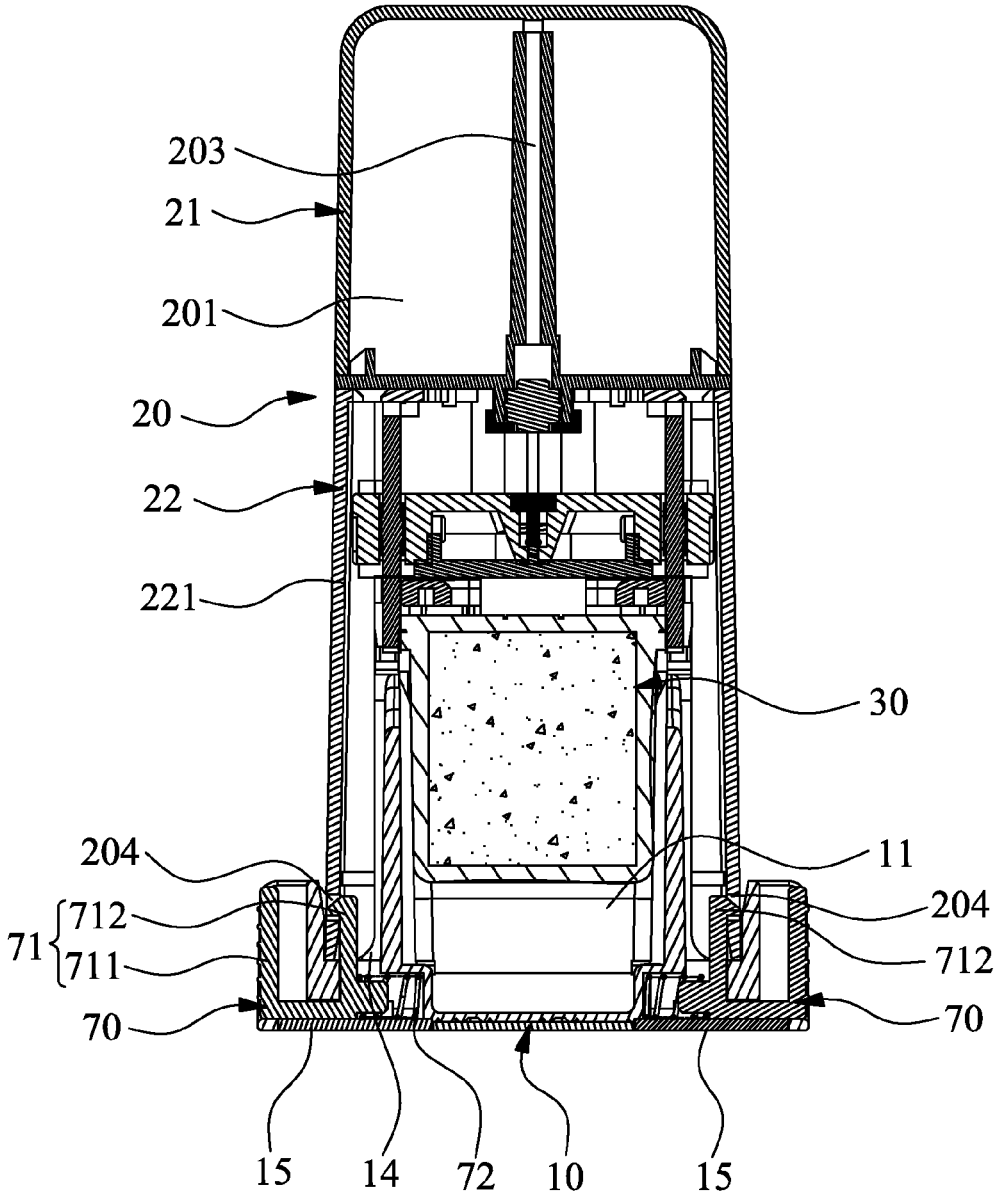
FIG. 8 is another cross sectional view of FIG. 7.

As shown in FIG. 8, the present invention further comprises a click-and-lock mechanism 70 which is disposed between the ink refill unit 20 and the ink cartridge holder 10. The locking mechanism 70 is used to connect the ink refill unit 20 and the ink cartridge holder 10 tightly. The locking mechanism 70 is disposed on the ink cartridge holder 10. The two opposing sides of the ink cartridge holder 10 are each provided with a locking mechanism 70. The locking mechanism 70 comprises a button 71 and a resilient member 72. The button 71 is mounted on the ink cartridge holder 10, and comprises a press portion 711 and a hook portion 712. The press portion 711 is exposed out of the ink cartridge holder 10. The outer casing 221 of the ink delivery member 22 has an engaging slot 204 corresponding to hook portion 712. The hook portion 712 is engaged with the engaging slot 204, such that the ink refill unit 20 is secured to the ink cartridge holder 10. The resilient member 72 is a spring. Two ends of the spring are against the ink cartridge holder 10 and the button 71, respectively. The spring acts on the button 71 to provide a force to the button 71 to be moved outward, such that the hook portion 712 is engaged in the engaging slot 204 so as to tightly connect the ink cartridge holder 10 and the ink refill unit 20. The ink cartridge holder 10 has an engaging trough 14 thereon. The hook portion 712 of the button 71 extends out from the bottom of the ink cartridge holder 10 into the engaging trough 14. The button 71 is restrained on the ink cartridge holder 10 by a limit board 15. The hook portion 712 is sideward moved in the engaging trough 14 back and forth. The edge of the outer casing 221 can be engaged in the engaging trough 14.

Figure 3:
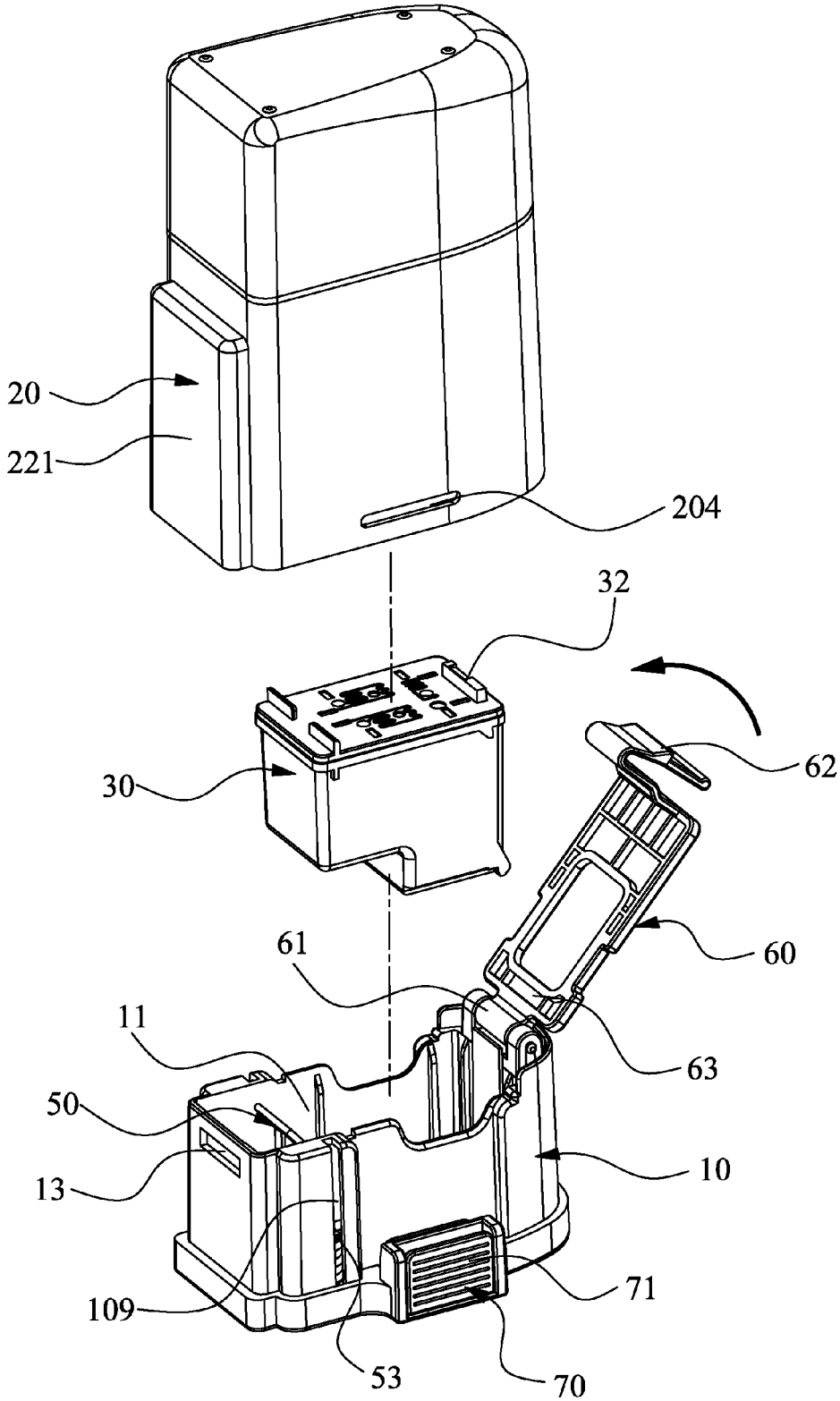
FIG. 3 is a partial exploded view of the preferred embodiment of the present invention.

As shown in FIG. 3, the ink cartridge 30 to be filled is placed in the accommodation chamber 11 of the ink cartridge holder 10. The ink cartridge 30 is guided into the accommodation chamber 11 through the inclined guide surface 511. By the elastic member 52 acting on the fastening block 51, the fastening block 51 transversely fastens the ink cartridge 30 and the two ends of the limit post 53 are moved in the engaging grooves 109. The ink cartridge 30 is moved downward until the nozzle 31 of the ink cartridge 30 is against the seal 104, sealing the nozzle 31 with the air extraction passage 103.

After that, the locking member 60 is rotated inward. The protrusion 32 of the ink cartridge 30 is engaged with the positioning recess 63 and the locking portion 62 of the locking member 60 is engaged with the locking slot 13 of the ink cartridge holder 10, such that the ink cartridge 30 is secured to the ink cartridge holder 10 securely.

Then, the ink refill unit 20 is coupled on the ink cartridge holder 10. The ink refill unit 20 is pressed down in place relative to the ink cartridge holder 10, the engaging ribs 205 of the ink cartridge unit 20 are engaged with the engaging grooves 109 of the ink cartridge holder 10 and urge the limit post 53 to move downward. Because the limit post 53 is moved downward, the piston 42 of the air extraction mechanism 40 is also moved downward to compress the air in the air cylinder 41. In this way, the first one-way valve 106 is closed and the second one-way valve 107 is opened, and then the air enters the recess 105 through the air exhaust passage. The air in the air cylinder 41 is exhausted, preventing the air in the air cylinder 41 from entering the ink cartridge 30 when in place. When the ink refill unit 20 is pressed down in place relative to the ink cartridge holder 10, the piston 42 is moved down to a certain distance. The return spring 43 is in a compressed state to engage the air extraction mechanism 40, so the air extraction mechanism 40 is in a state to prime.

As shown in FIG. 7 and FIG. 8, when the ink refill unit 20 is pressed down relative to the ink cartridge holder 10, the upper end of the ink needle 222 penetrates into the ink chamber 201, and the lower end of the ink needle 222 extends into the ink cartridge 30. The ink needle 222 connects the ink chamber 201 and the inside of the ink cartridge 30. The upper end of the ventilated needle 223 extends into the ventilated post 203, and the lower end of the ventilated needle 223 extends into the ink cartridge 30. The ventilated needle 223 connects the ventilated post 203 and the inside of the ink cartridge 30. The ink in the ink chamber 201 is delivered to the ink cartridge 30 through the ink needle 222. The air in the ink cartridge 30 is exhausted out through the ventilated needle 223.

When the ink refill unit 20 is pressed down in place relative to the ink cartridge holder 10, the button 71 of locking mechanism 70 is moved outward. With the resilient member 72 to provide a reverse force to the button 71, the button 71 is moved in a reverse direction. The hook portion 712 of the button 71 engages with the engaging slot 204 of the outer casing 221, such that the ink refill unit 20 is tightly coupled to the ink cartridge holder 10.

After the ink cartridge 30 is filled with ink, the button 71 of the locking mechanism 70 is pressed and the hook portion 712 of the button 71 disengages from the engaging slot 204. Then, the ink refill unit 20 is detached from the ink cartridge holder 10. When the ink refill unit 20 is detached from the ink cartridge holder 10, the limit post 53 is released. By the action of the return spring 43, the piston 42 is returned up. The air pressure in the air cylinder 41 is decreased, so the first one-way valve 106 is opened and the second one-way valve 107 is closed. The air in the nozzle 31 of the ink cartridge 30 enters the air cylinder 41 through the air extraction passage 103.

After the nozzle 31 of the ink cartridge 30 is primed, the locking portion 62 of the locking member 60 is disengaged from the locking slot 13 and the locking member 60 is turned outward to release the ink cartridge 30 from the locking member 60, so that the ink cartridge 30 can be taken out from the accommodation chamber 11. Now, the ink cartridge 30 is filled with ink, primed and can be placed in a printer for use.

It is noted that the air extraction passage 103 and the air exhaust passage in the preferred embodiment of the present invention can be replaced with a single passage performing both functions. The passage connects the air extraction mechanism 40 and the nozzle 31 of the ink cartridge 30, so the nozzle 31 of the ink cartridge 30 can be primed by the air extraction mechanism 40. The same passage is used to extract and exhaust air so as to achieve prime of the nozzle 31 of the ink cartridge 30. The configuration of the aforesaid passages is limited to the recess formed at the bottom of the ink cartridge holder 10 in conjunction with the bottom plate. These passages can be formed by a recess formed on the bottom plate to cooperate with the bottom of the ink cartridge holder 10.

Moreover, the air extraction mechanism 40 is not limited to the aforesaid configuration, which can be in another type of air extraction mechanism (such as a button-type air extraction mechanism). The air extraction mechanism can be automatic or manual. The requirement for the air extraction mechanism is that it extract air from the ink cartridge 30 after the ink cartridge 30 is filled with ink.

Figure 10:
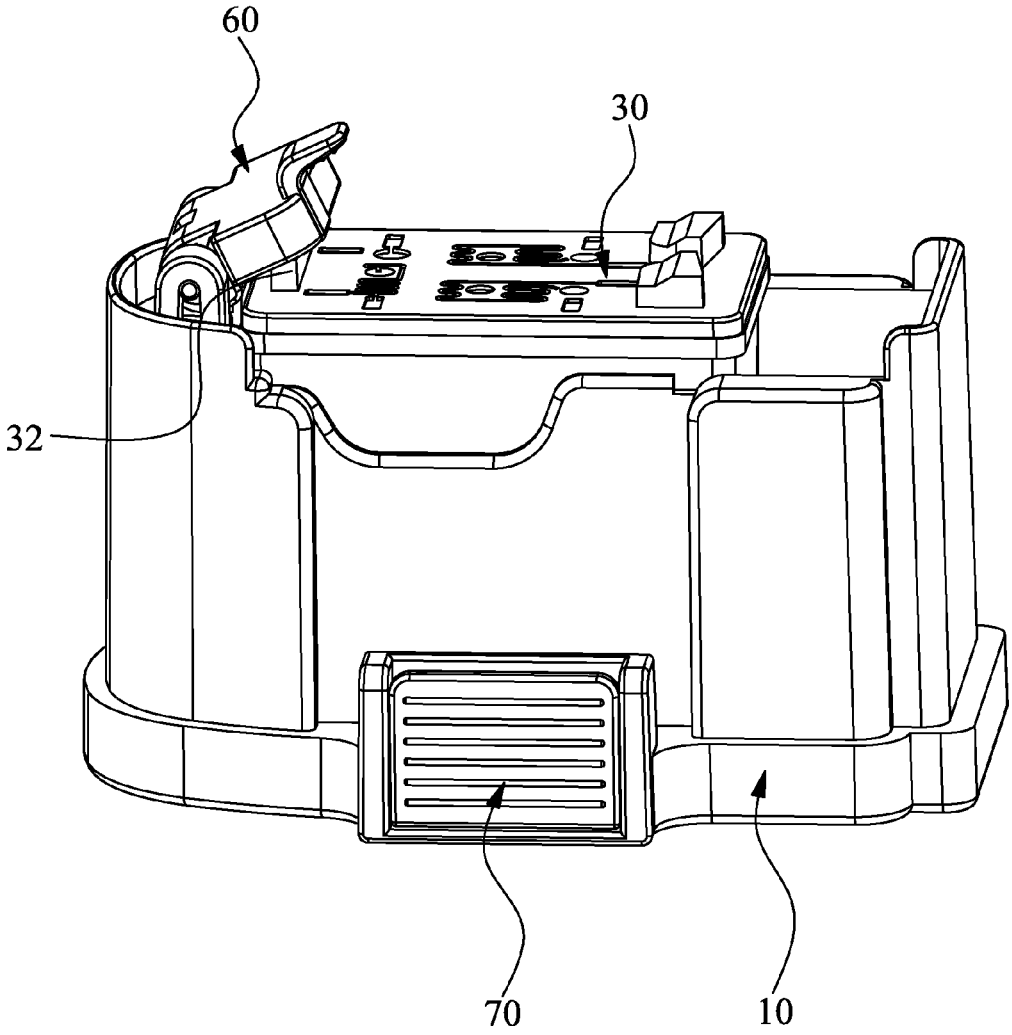
FIG. 10 is a schematic view showing the ink cartridge holder and the ink cartridge of the preferred embodiment of the present invention.

Furthermore, the locking member 60 can be in other configurations. As shown in FIG. 10, one end of the locking member 60 is pivotally connected to the ink cartridge holder 10 and the other end of the locking member 60 is engaged with the protrusion 32 of the ink cartridge 30. After the locking member 60 is engaged with the protrusion 32, the locking member 60 is coupled to the ink cartridge holder 10 and cannot be turned, so that the ink cartridge 30 is secured in the ink cartridge holder 10 and the press portion of the locking member 60 covers the nozzle 31 of the ink cartridge 30.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An ink cartridge refill apparatus, comprising an ink cartridge holder and an ink refill unit matched with each other, the ink cartridge holder having an accommodation chamber therein to accommodate an ink cartridge, the ink refill unit comprising an ink tank and an ink delivery unit, the ink delivery unit being used to deliver ink from the ink tank to the ink cartridge in the accommodation chamber, characterized by: an air extraction mechanism provided on the ink cartridge holder, the air extraction mechanism being used to extract air from the ink cartridge, the ink cartridge holder having a passage for the air extraction mechanism to extract air relative to a nozzle of the ink cartridge, wherein, when the ink refill unit is being pressed down in place relative to the ink cartridge holder, the air extraction mechanism is engaged to be in a state waiting to prime; and, when the ink refill unit is bring detached from the ink cartridge holder, the air extraction mechanism extracts air from the ink cartridge, priming the ink cartridge, wherein the air extraction mechanism is disposed in the accommodation chamber, the air extraction mechanism comprising an air cylinder, a piston and a return spring, the air cylinder being integrally formed with the accommodation chamber, the air cylinder having a bottom formed with an air hole, the passage being disposed on a bottom of the accommodation chamber, the passage communicating with the air hole, the piston being movably disposed in the air cylinder, the return spring acting on the piston to provide an upward return force to the piston, wherein, when the ink refill unit is being pressed down in place relative to the ink cartridge, the piston is being moved down and the air extraction mechanism being in a state waiting to prime; and, when the ink refill unit is being detached from the ink cartridge holder, the air extraction mechanism extracts air from the ink cartridge.

2. The ink cartridge refill apparatus as claimed in claim 1, wherein the accommodation chamber of the ink cartridge holder is provided with a fastening mechanism which is used to fasten the ink cartridge, the fastening mechanism being located on the piston of the air extraction mechanism to move along with movement of the piston, the fastening mechanism comprising a fastening block and an elastic member, the fastening block being transversely moved relative to the piston, the elastic member acting on the fastening block so that the fastening block extending transversely to fasten the ink cartridge.

3. The ink cartridge refill apparatus as claimed in claim 2, wherein the fastening block further has a limit post, an inner wall of the accommodation chamber having a pair of limit troughs corresponding to two ends of the limit post, the two ends of the limit post being moved vertically and transversely and confined in the limit troughs, one end of the fastening block being fixedly connected to the limit post and another end of the fastening block having an inclined guide surface, the fastening block being transversely moved relative to the piston through the guide block and a guide groove.

4. The ink cartridge refill apparatus as claimed in claim 3, wherein an upper end of the piston has a guide block, the guide groove being disposed on the fastening block, the guide groove being a dovetail groove, the guide block being engaged in the guide groove.

5. The ink cartridge refill apparatus as claimed in claim 3, wherein two sides of the ink cartridge holder have a pair of upright engaging grooves, the two ends of the limit post being located in the engaging grooves, the ink refill unit having engaging ribs corresponding to the engaging grooves, when the ink refill unit being pressed down, the engaging ribs engaging with the engaging grooves and urging the limit post to move downward, the downward movement of the limit post bringing the piston to move downward.

6. The ink cartridge refill apparatus as claimed in claim 1, wherein the passage includes an air extraction passage and an air exhaust passage, the air extraction passage communicating the nozzle of the ink cartridge and the air hole of the air extraction mechanism, the exhaust passage being used to exhaust the air in the air extraction mechanism, the air extraction passage being provided with a first one-way valve, the air exhaust passage being provided with a second one-way valve.

7. The ink cartridge refill apparatus as claimed in claim 6, wherein the first one-way valve is disposed at an air inlet end of the air extraction passage, and the second one-way valve is disposed at an air exhaust hole of the air extraction mechanism.

8. The ink cartridge refill apparatus as claimed in claim 6, wherein the ink cartridge holder comprises a bottom plate which is detachedly connected to a bottom of the ink cartridge holder, the bottom of the ink cartridge holder having a first groove and a second groove, the bottom plate and the first groove as well as the second groove respectively defining the an air extraction passage and the air exhaust passage.

* * * * *